US006464480B2

(12) United States Patent
Fenocchi et al.

(10) Patent No.: US 6,464,480 B2
(45) Date of Patent: Oct. 15, 2002

(54) OIL SPOUT FOR SCROLL COMPRESSOR

(75) Inventors: David M. Fenocchi; Carlos Armando Zamudio; Paul Edward Murphy, all of Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/810,076

(22) Filed: Mar. 16, 2001

(65) Prior Publication Data

US 2002/0131879 A1 Sep. 19, 2002

(51) Int. Cl.[7] ..... F04B 17/00
(52) U.S. Cl. ..... 418/55.6; 418/55.4; 418/94
(58) Field of Search ..... 418/556, 554, 418/94; 417/410.5

(56) References Cited

U.S. PATENT DOCUMENTS

| | | | | |
|---|---|---|---|---|
| 4,623,306 A | * | 11/1986 | Nakamura et al. | 184/6.18 |
| 4,702,683 A | * | 10/1987 | Inaba et al. | 184/6.18 |
| 5,263,822 A | * | 11/1993 | Fujio | 418/55.4 |
| 5,295,813 A | | 3/1994 | Caillat et al. | |
| 5,616,016 A | * | 4/1997 | Hill et al. | 418/55.4 |
| 5,720,602 A | | 2/1998 | Hill et al. | |
| 6,017,205 A | | 1/2000 | Weatherston et al. | |
| 6,042,346 A | * | 5/2000 | Doi | 417/371 |
| 6,129,531 A | * | 10/2000 | Elson et al. | 418/55.6 |
| 6,149,413 A | * | 11/2000 | Lifson | 418/55.1 |
| 6,386,840 B1 | * | 5/2002 | Williams et al. | 417/371 |

FOREIGN PATENT DOCUMENTS

| | | | | |
|---|---|---|---|---|
| EP | 469700 A1 | * | 2/1992 | F04C/29/02 |
| JP | 07 119 649 A | | 5/1995 | |
| JP | 07 127 587 A | | 5/1995 | |
| JP | 07 151 077 A | | 6/1995 | |
| JP | 07 324 690 A | | 12/1995 | |
| JP | 08 061 277 A | | 3/1996 | |
| JP | 08 061 278 A | | 3/1996 | |
| JP | 08 074 760 A | | 3/1996 | |
| JP | 08 277 791 A | | 10/1996 | |
| JP | 08 303 378 A | | 11/1996 | |
| JP | 09 042 181 A | | 2/1997 | |
| JP | 09 079 154 A | | 3/1997 | |
| JP | 09 060 597 A | | 4/1997 | |
| JP | 09 209 957 A | | 8/1997 | |
| JP | 09 217 690 A | | 8/1997 | |
| JP | 09 250 465 A | | 9/1997 | |
| JP | 09 287 579 A | | 11/1997 | |
| JP | 10 274 176 A | | 10/1998 | |

* cited by examiner

*Primary Examiner*—Cheryl J. Tyler
*Assistant Examiner*—Emmanuel Sayoc
(74) *Attorney, Agent, or Firm*—Carlson Gaskey & Olds

(57) ABSTRACT

An oil spout is drilled in the crankcase of a scroll compressor between the outer seal and the coupling. The oil spout intersects the oil return chamber to redirect a portion of the oil exiting the oil return passage to the lower surface of the orbiting scroll between the outer seal and the coupling. It is preferred that the oil spout be substantially perpendicular to and smaller in diameter than the oil return passage. The oil spout provides a continual flow of additional lubrication to the outer seal and the coupling, preventing excessive wear of the outer seal and improving overall seal reliability.

18 Claims, 3 Drawing Sheets

OIL SPOUT FOR SCROLL COMPRESSOR

BACKGROUND OF THE INVENTION

The present invention relates generally to an oil spout which provides lubrication to the outer seal and coupling of a scroll compressor.

Scroll compressors are utilized in many refrigerant compression applications. In a typical scroll compressor, a pump unit is incorporated within a hermetically sealed housing. A refrigerant is introduced into the housing in a suction chamber through a suction tube. Typically, an electric motor drives a shaft which powers the pump unit. This refrigerant passes over the electric motor, cooling the motor.

The refrigerant then passes into a pump unit and is compressed. The compressor pump unit comprises a pair of scroll members. A scroll compressor includes two opposed scroll members each having a base and a generally spiral wrap extending from the base. One of the two scroll members is driven to orbit relative to the other. The wraps interfit, and as the wraps orbit, compression chambers defined between the wraps are reduced in volume. The refrigerant is then passed to a discharge chamber.

One problem presented by scroll compressors is that the compressed refrigerant can strive the two scroll members away from each other. Thus, a compressed refrigerant is tapped to a "back pressure" chamber behind one of the two scroll members. An inner and an outer seal defines the "back pressure" chamber on the rear face of the scroll member. Further, an Oldham coupling is to be positioned outwardly of the seals, and includes moving members which can strain the orbiting scroll member to orbit rather than rotate.

During operation, lubrication is wiped off of the seal/scroll interface, resulting in excessive wear on the outer seal. Additionally, galling occurs on the coupling. Prior scroll compressors have not provided direct lubrication to the outer seal and coupling.

Hence, there is a need in the art for an oil spout which provides lubrication to the outer seal and coupling of a scroll compressor.

SUMMARY OF THE INVENTION

The present invention relates to an oil spout which provides lubrication to the outer seal and coupling of a scroll compressor An oil spout is drilled in the crankcase of a scroll compressor between the outer seal and the coupling to provide lubrication. The oil spout redirects a portion of the oil exiting an oil return passage to the lower surface of the orbiting scroll between the outer seal and the coupling.

In the preferred embodiment, the oil spout is substantially perpendicular to the oil return passage. Additionally, in the preferred embodiment, the oil spout is smaller in diameter than the oil return passage.

The oil spout provides a continual flow of lubrication to the outer seal and the coupling, preventing excessive wear of the outer seal and improving overall seal reliability. Additionally, galling of the coupling is minimalized.

Accordingly, the present invention provides an oil spout which provides lubrication to the outer seal and coupling of a scroll compressor.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
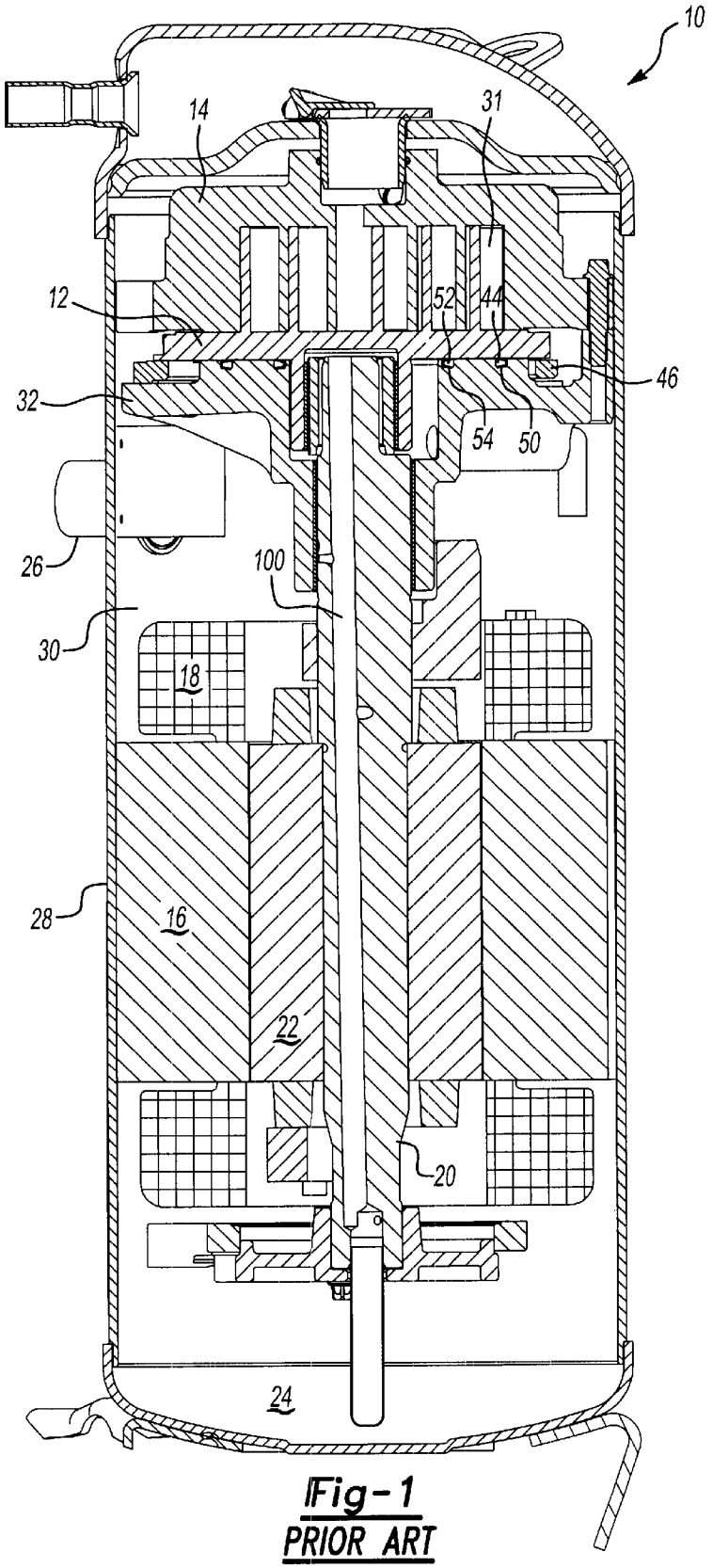
Fig-1 PRIOR ART
FIG. 1 illustrates a cross sectional view of a prior art scroll compressor.

A known scroll compressor 10 is illustrated in FIG. 1. The scroll compressor 10 incorporates an orbiting scroll 12 and a non-orbiting or fixed scroll 14. A motor 16 includes stator windings 18 driving a shaft 20 through a motor rotor 22. The shaft 20 and the motor 16 are positioned above an oil sump 24. A suction tube 26 enters a compressor housing 28 and supplies refrigerant into a space 30 which communicates with the scroll compressor chambers 31. As shown, a crankcase 32 supports the orbiting scroll 12. The crankcase 32 includes an outer groove 50 and an inner groove 54. The outer groove 50 contains an outer seal 44 and the inner groove 54 contains an inner seal 52. A coupling 46 is utilized to prevent rotation of the orbiting scroll 12 and cause orbital motion. There is a problem in supplying sufficient lubrication to the seals and coupling. A lubricant passage 100 extends through the shaft 20

Figure 2:
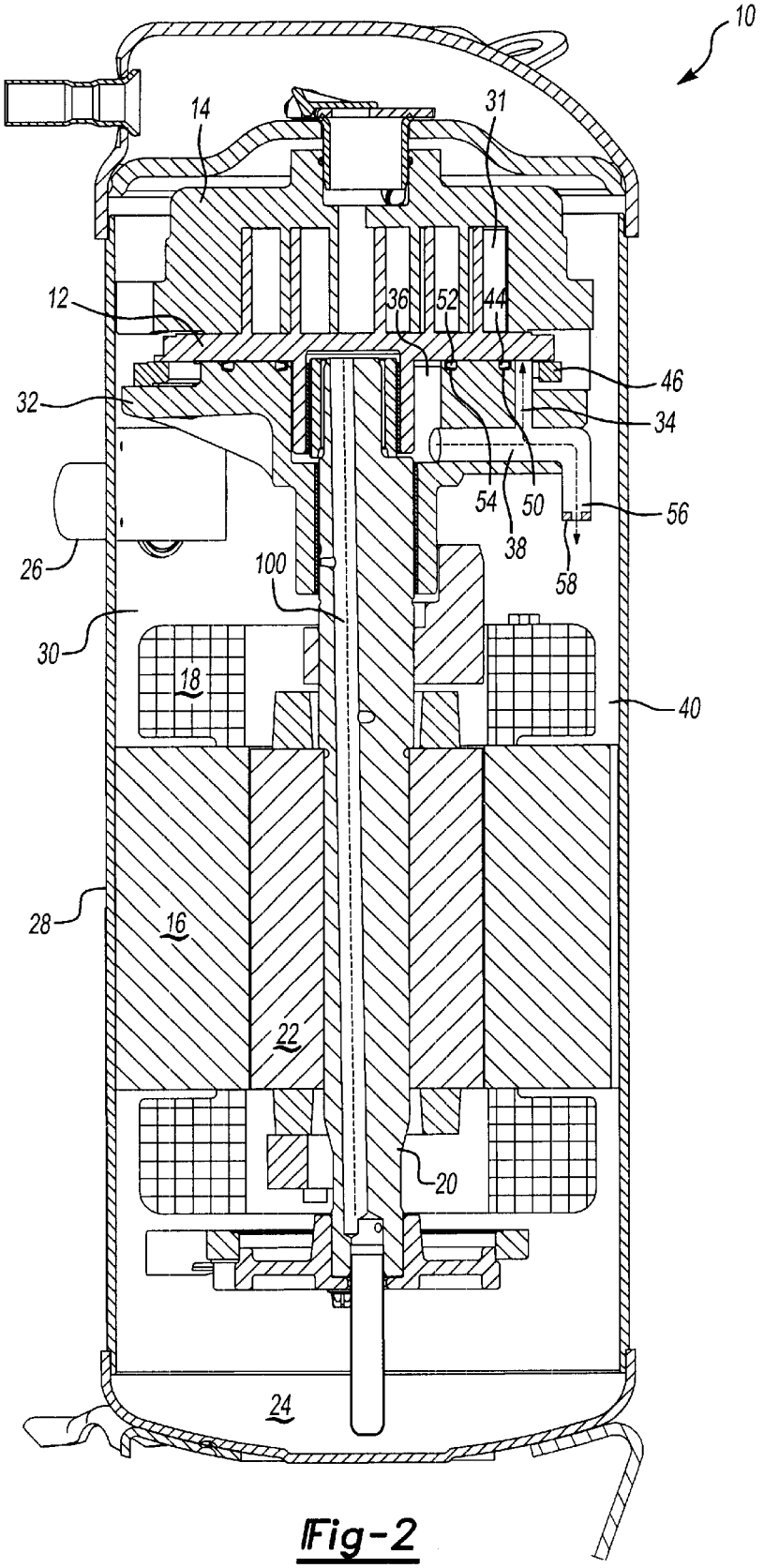
FIG. 2 illustrates a cross sectional view of a scroll compressor utilizing the oil spout of the present invention.
Figure 3:
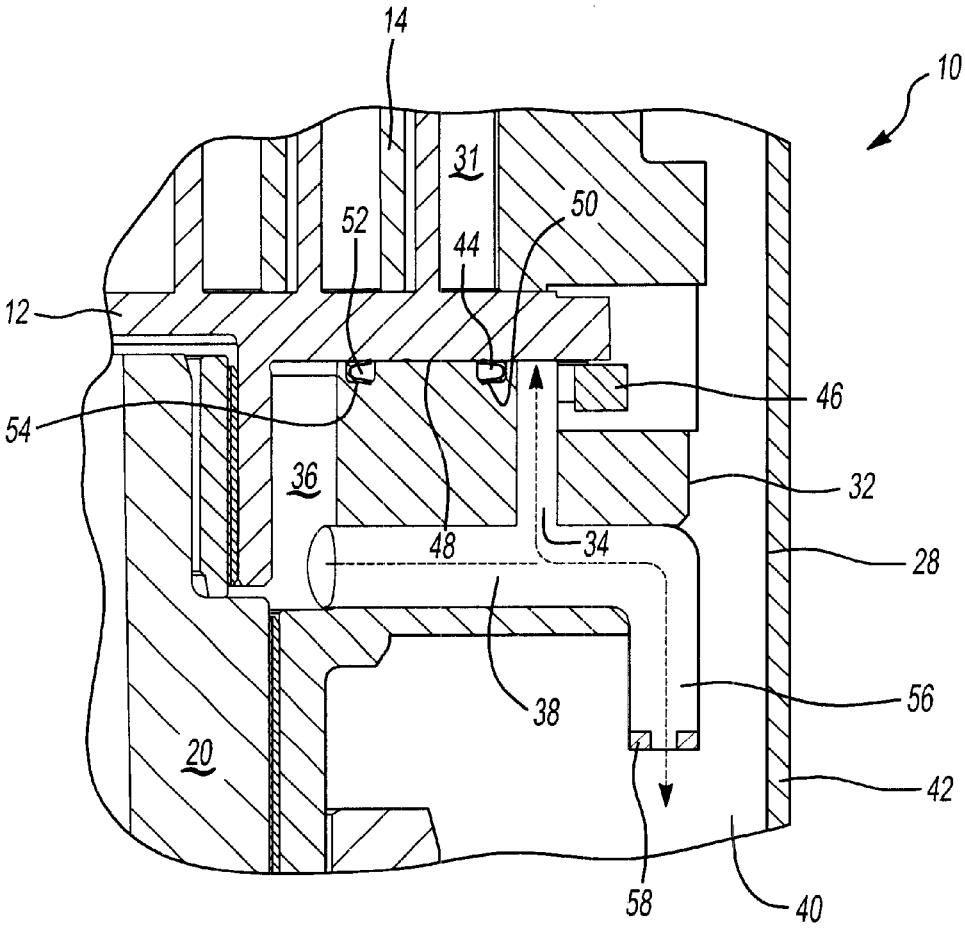
FIG. 3 illustrates an enlarged portion of FIG. 2.

FIGS. 2 and 3 illustrate a scroll compressor 10 utilizing the oil spout 34 of the present invention. The scroll compressor 10 further includes an oil return chamber 36 which is defined between the crankcase 32 and the orbiting scroll 12. An oil return passage 38 extends radially outwardly from the oil return chamber 36 through the crankcase 32 to allow oil to return to the sump 24.

The oil spout 34 is drilled in the crankcase 32 substantially between the outer seal 44 and the coupling 46. The oil spout 34 intersects the oil return chamber 36 to redirect a portion of the oil flowing through the oil return passage 38 to the lower surface 48 of the orbiting scroll 12. The oil spout 34 is positioned so that the oil flowing through the oil spout 34 substantially splashes the outer seal 44 and the coupling 46.

During operation, oil travels through passage 100 and the shaft 20 from the oil sump 24 and enters into the oil return chamber 36. Oil then flows into the oil return passage 38. The oil that exits the oil return passage 38 drips down an oil drain tube 56 and flows into a space 40 downwardly into the oil sump 24. The oil spout 34 redirects a portion of the oil that enters the oil return passage 38 to supply lubrication between the outer seal 44 and the coupling 46.

In the preferred embodiment, the oil drain tube 56 further includes a restriction 58. The restriction 58 partially blocks the oil drain tube 56 to redirect a portion of the oil to the outer seal 44 and coupling 46. In one embodiment, the restriction 58 is a plug. In another embodiment, the scroll compressor 10 does not include the oil drain tube 56. The restriction 58 is positioned within the oil return passage 38 and oil which exits the oil returns passage 38 flows into the oil sump 24.

In the preferred embodiment, the oil return passage 38 is substantially parallel to the lower surface 48 of the orbiting scroll 12, and the oil spout 34 is substantially perpendicular to the oil return passage 38. However, the oil return passage 38 can be at any angle relative to the lower surface 48 of the orbiting scroll 12, resulting in the oil spout 34 being angled or slanted from the oil return passage 38.

It is also preferred that the oil spout 34 be substantially smaller in diameter than the oil return passage 38. This allows an amount of oil to pass through the oil spout 34 which is less than the amount of oil which passes through the oil return passage 38. However, it is to be understood that the oil spout 34 can be of any diameter.

During operation of the scroll compressor 10, excessive wear occurs on the outer seal 44. Additionally, galling occurs on the coupling 46. Any existing lubrication is wiped off during operation due to the orbital motion of the scroll compressor 10. By providing additional lubrication through the oil spout 34 between the outer seal 44 and the coupling 46, wear is prevented.

The oil spout 34 provides a continual flow of additional lubrication to the outer seal 44 and the coupling 46 of the scroll compressor 10 by diverting oil from the oil return passage 38 through the oil spout 34. The oil spout 34 provides an alternative path for the oil which exits through the oil return passage 38, providing lubrication to the seal 44 and the coupling 46.

There are several advantages to utilizing an oil spout 34. One main advantage is that by providing continual lubrication, wearing of the outer seal 44 can be minimized, improving overall seal 44 reliability and the overall reliability of the scroll compressor 10.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A scroll compressor comprising:

a first scroll member including a base and a generally spiral wrap extending from said base;

a second scroll member including a base and a generally spiral wrap extending from said base, said generally spiral wrap of said first and second scroll members interfitting to define compression chambers;

a crankcase to support said second scroll member including an oil spout, an oil return passage, a groove containing a seal, and a coupling radially outwardly of said seal, said oil return passave is formed as a bore within said crank case, and said oil spout extends from said oil return passape in a direction toward said second scroll member to supply lubricant between said seal and said coupling; and an oil supply system including said oil return passage which communicates with a sump, said oil spout communicating with said oil return passage to supply lubricant between said seal and said coupling.

2. The scroll compressor as recited in claim 1 wherein said oil spout is substantially perpendicular to said oil return passage.

3. The scroll compressor as recited in claim 1 wherein said oil spout is smaller in diameter than said oil return passage.

4. The scroll compressor as recited in claim 1 wherein said oil spout extends from said oil return passage to said base of said second scroll member.

5. The scroll compressor as recited in claim 1 wherein said oil spout provides a continual flow of lubrication between said seal and said coupling.

6. The scroll compressor as recited in claim 1 wherein an amount of lubrication supplied between said seal and said coupling is substantially less than an amount of lubrication exiting said oil return passage.

7. The scroll compressor as recited in claim 1 wherein said oil return passage further includes a restriction to partially block flow of said lubricant through said oil return passage and to redirect a portion of said lubricant to said oil spout.

8. The scroll compressor as recited in claim 7 wherein said restriction is a plug.

9. The scroll compressor as recited in claim 1 wherein said oil return passage is an oil drain tube.

10. A scroll compressor comprising:

a first scroll member including a base and a generally spiral wrap extending from said base;

a second scroll member including a base and a generally spiral wrap extending from said base, said generally spiral wrap of said first and second scroll members interfitting to define compression chambers;

a crankcase to support said second scroll member including an oil spout, a groove containing a seal, and a coupling radially outwardly extending of said seal, said oil return passage is formed as a bore within said crank case, and said oil spout extends from said oil return passage in a direction toward said second scroll member;

a shaft for driving said second scroll member to orbit relative to said first scroll member;

an electric motor having a rotor for driving said shaft and a stator powering said rotor; and an oil supply system including said oil spout and an oil return passage which communicates with a sump, said oil spout communicating with said oil return passage to supply lubricant between said seal and said coupling.

11. The compressor as recited in claim 10 wherein said oil spout is substantially perpendicular to said oil return passage.

12. The compressor as recited in claim 10 wherein said oil spout is smaller in diameter than said oil return passage.

13. The compressor as recited in claim 10 wherein said oil spout extends from said oil return chamber to said base of said second scroll member.

14. The scroll compressor as recited in claim 10 wherein said oil spout provides a continual flow of lubrication between said seal and said coupling.

15. The scroll compressor as recited in claim 10 wherein amount of lubrication supplied between said seal and said coupling is substantially less than an amount of lubrication exiting said oil return passage.

16. The scroll compressor as recited in claim 10 wherein said oil return passage further includes a restriction to partially block flow of said lubricant through said oil return passage and to redirect a portion of said lubricant to said oil spout.

17. The scroll compressor as rccitcd in claim 16 wherein said restriction is a plug.

18. The scroll compressor as recited in claim 10 wherein said oil return passage is an oil drain tube.

* * * * *

UNITED STATES PATENT AND TRADEMARK OFFICE

CERTIFICATE OF CORRECTION

PATENT NO. : 6,464,480 B2
DATED : October 15, 2002
INVENTOR(S) : Fenocchi et al.

It is certified that error appears in the above-identified patent and that said Letters Patent is hereby corrected as shown below:

Column 3,
Line 50, “passave” should be -- passage --

Column 4,
Line 61, “rccited” should be -- recited --.

Signed and Sealed this

Eighteenth Day of February, 2003

JAMES E. ROGAN
*Director of the United States Patent and Trademark Office*